US006184745B1

(12) United States Patent
Kim

(10) Patent No.: US 6,184,745 B1
(45) Date of Patent: Feb. 6, 2001

(54) REFERENCE VOLTAGE GENERATING CIRCUIT

(75) Inventor: Tae-Hoon Kim, Seoul (KR)

(73) Assignee: LG Semicon Co., Ltd., Choongcheongbuk-Do (KR)

( * ) Notice: Under 35 U.S.C. 154(b), the term of this patent shall be extended for 0 days.

(21) Appl. No.: 09/178,476

(22) Filed: Oct. 26, 1998

(30) Foreign Application Priority Data

Dec. 2, 1997 (KR) ..... 97-65207

(51) Int. Cl.[7] ..... G05F 3/24; G05F 3/26

(52) U.S. Cl. ..... 327/541; 327/543; 323/314; 323/315

(58) Field of Search ..... 327/538, 539, 327/540, 541, 542, 543; 323/313, 314, 315

(56) References Cited

U.S. PATENT DOCUMENTS 4,935,690 * 6/1990 Yan ..... 323/314
5,077,518 * 12/1991 Han ..... 323/275
5,173,656 * 12/1992 Seevinck et al. ..... 323/316
5,204,612 * 4/1993 Lingstaedt ..... 323/315
5,448,159 * 9/1995 Kojima et al. ..... 323/315
5,881,015 * 3/1999 Kim ..... 365/229
5,917,765 * 6/1999 Morishita et al. ..... 365/201
6,005,434 * 3/1999 Tsukikawa et al. ..... 327/537

OTHER PUBLICATIONS

Hoi–Jun Yoo et al.; "A Precision CMOS Voltage Reference with Enhanced Stability for the Application to Advanced VLSI's"; 1993 IEEE; pp. 1318–1321.

* cited by examiner

*Primary Examiner*—Timothy P. Callahan
*Assistant Examiner*—Terry L. Englund
(74) *Attorney, Agent, or Firm*—Morgan, Lewis & Bockius LLP

(57) ABSTRACT

A reference voltage generating circuit generates a reference voltage by using a voltage difference of a PMOS transistor, to thereby exclude the reliability of a back-bias voltage. The reference voltage generating circuit includes a reference voltage generating unit which generates a first reference voltage with respect to a power supply voltage, and a level converting unit which converts the first reference voltage applied from the reference voltage generating unit to a second reference voltage with respect to a ground voltage.

16 Claims, 4 Drawing Sheets

REFERENCE VOLTAGE GENERATING CIRCUIT

BACKGROUND OF THE INVENTION

1. Field of the Invention

The present invention relates to a reference voltage generating circuit, and more particularly to a MOS-type reference voltage generating circuit.

2. Description of the Background Art

FIG. 1 illustrates a conventional reference voltage generating circuit using a voltage difference Vgs between a gate and a source of an NMOS transistor.

First and second PMOS transistors P11, P12 constitute a current mirror and first and second NMOS transistors N11, N12 are respectively connected between each drain of the first and second PMOS transistors P11, P12 and a ground. A back-bias voltage Vbb is applied to each substrate of the first and second NMOS transistors N11, N12 for the purpose of effectively diminishing a threshold voltage change, and gates of the first and second NMOS transistors N11, N12 are commonly connected to an output node A.

The operation of the thusly constructed reference voltage generating circuit will be described hereinafter with reference to the accompanying drawings.

In FIG. 1, each of the PMOS transistors P11, P12 has the identical length and width. On the other hand, the NMOS transistors N11, N12 have the same length but a width of the first NMOS transistor N11 is greater than that of the second NMOS transistor N12 ($W_{n11}>W_{n12}$). Here, it is assumed that the ratio of the width of the first NMOS transistor N11 and that of the second NMOS transistor N12 is K ($K=W_{n11}/W_{n12}$), and currents towards the NMOS transistors N11, N12 are indicated as $I_{n11}$, $I_{n12}$, respectively.

On such an assumption, an operation current applied to the output node A from the NMOS transistors N11, N12 may be represented by a following equation (1).

$$Iop = \frac{Vgs(N12) - Vgs(N11)}{R1} \tag{1}$$

Here, Vgs(N12) denotes a voltage difference between the gate and source of the NMOS transistor N12 and Vgs(N11) is a voltage difference between the gate and source of the NMOS transistor N11.

If the NMOS transistors N11, N12 operate in a saturation region, each of the currents $I_{n11}$, $I_{n12}$, which are applied to the first and the second NMOS transistors N11, N12, respectively, may be expressed as follows.

$$I_{N11} = \frac{\beta_1}{2}[Vgs(N12) - Vtn]^2 = \frac{\beta_1}{2}[Vref1 - V_B - Vtn] \tag{2}$$

$$I_{N12} = \frac{\beta_2}{2}[Vgs(N11) - Vtn]^2 = \frac{\beta_2}{2}[Vref1 - Vtn] \tag{3}$$

Here, Vtn denotes a threshold voltage of the NMOS transistors N11, N12, $V_B$ denotes a voltage of a node B ($V_B=I_{N11}\times R1$), and each of $\beta_1$, $\beta_2$ which are the process parameters represents a transconductance. In addition, it is noted that $$\beta = \frac{U_N \varepsilon}{t_{ox}}\left(\frac{W}{L}\right),$$

wherein $U_N$ is electronic mobility of each of the NMOS transistors, $\epsilon$ is a dielectric constant, and $t_{ox}$ is a gate oxide thickness.

Thus, by virtue of the current mirror operation of the PMOS transistors P11, P12, when equalizing the values of the currents $I_{n11}$, $I_{n12}$, being applied to the NMOS transistors N11, N12, respectively, an equation (4) can be obtained from the equations (2) and (3).

$$Vref - Vtn = \frac{K \cdot I_{N11} R1}{H - 1}, \tag{4}$$

$$K = \sqrt{\frac{\beta_1}{\beta_2}}$$

Accordingly, the operation current ($I_{OP}=I_{N11}=I_{N12}$), and a reference voltage Vref can be represented with each of equations as follows.

$$I_{op} = \frac{2}{R1^2\beta_1}(K-1)^2 \tag{5}$$

$$Vref = Vtn + \frac{2}{R1 \cdot \beta_2}\left(1 - \frac{1}{K}\right) \tag{6}$$

Thus, according to the equation (6), since the reference voltage Vref is determined by the threshold voltage Vtn, resistance R1, the process parameter $\beta_2$, and a constant K, the reference voltage Vref may be generated irrespective of any change of a power supply voltage Vcc.

In addition, an effect of a temperature change on the reference voltage Vref may appear dependently upon a temperature change of each of the above parameters. Namely, the threshold voltage Vtn generally has −1 mV/° C. of a temperature dependency, and the resistance R of which a gate is formed of a doped polysilicon has +0.01/° C. thereof. Also, the electronic mobility $U_N$ varies by $$T^{-\frac{3}{2}}$$

each time in accordance with temperature, and thus the process parameter $\beta_2$ also shows $$T^{-\frac{3}{2}}$$

of a temperature dependency.

Accordingly, when $$\frac{2}{R1 \cdot \beta_2}\left(1 - \frac{1}{K}\right)$$

is to have +1 mV/° C. of the temperature dependency, the reference voltage Vref can be generated, regardless of any temperature change.

In the conventional reference voltage generating circuit, however, the threshold voltage Vtn of the NMOS transistors N11, N12 may vary in accordance with the back-bias voltage Vbb which is applied to the corresponding substrates of the first and second NMOS transistors N11, N12.

That is to say, a bulk of each of the NMOS transistors N11, N12 is connected to a p-type substrate and the p-type substrate is biased at a negative back-bias voltage Vbb which is generated inside a chip device. Accordingly, the back-bias voltage Vbb generates a voltage difference Vsb between the source and the bulk of each of the NMOS transistors N11, N12, and thus has an effect on the threshold voltage Vtn as a following equation (7).

$$Vtn=Vtn0+\gamma\sqrt{\sqrt{Vsb}} \quad (7)$$

In the equation (7), Vtn0 is the value of the threshold voltage Vtn when Vsb=0, γ is a body effect factor which has a value of the range between 0.4 to 1.2 according to doping condition, and Vsb is the voltage difference between the source and the bulk of the NMOS transistor.

FIG. 2 is a graph which illustrates a change of the threshold voltage Vtn in accordance with which the back-bias voltage Vbb varies, and shows that as an absolute value of the back-bias voltage Vbb increases, the threshold voltage Vtn thus correspondingly increases.

FIG. 3 is a graph illustrating a simulation result which shows a change of the reference voltage Vref with respect to the back-bias voltage Vbb. The reference voltage Vref is not considerably affected by the change of the power supply voltage Vcc when the back-bias voltage Vbb is uniformly maintained; however, when the back-bias voltage Vbb changes, the voltage Vref accordingly has a dependency of +178 mV/V. Moreover, since the back-bias voltage Vbb is generally equivalent to −½ of the power supply voltage Vcc, the absolute value of the back-bias voltage Vbb also increases as the power supply voltage Vcc increases. As a result, when the absolute value of the back-bias voltage Vbb increases, the threshold voltage Vtn increases in accordance therewith and thus the reference voltage Vref consequently increases, which leads to the problem.

SUMMARY OF THE INVENTION

An object of the present invention is to provide a reference voltage generating circuit that substantially obviates at least one of the problems or disadvantages of the conventional art.

Another object of the present invention is to provide a reference voltage generating circuit that generates an uniform reference voltage regardless of any change of a back-bias voltage by using a voltage difference between a gate and a source of a PMOS transistor.

To achieve at least the above-described objects in a whole or in parts, there is provided a reference voltage generating circuit according to the present invention that includes a reference voltage generating unit for generating a first reference voltage with respect to a power supply voltage, and a level converting unit for converting the first reference voltage supplied from the reference voltage generating unit to a second reference voltage with respect to a ground voltage.

It is to be understood that both the foregoing general description and the following detailed description are exemplary and explanatory and are intended to provide a further explanation of the invention as claimed.

BRIEF DESCRIPTION OF THE DRAWINGS

The invention will be described in detail with reference to the following drawings in which like reference numerals refer to like elements wherein.

DETAILED DESCRIPTION OF THE INVENTION

Figure 1:
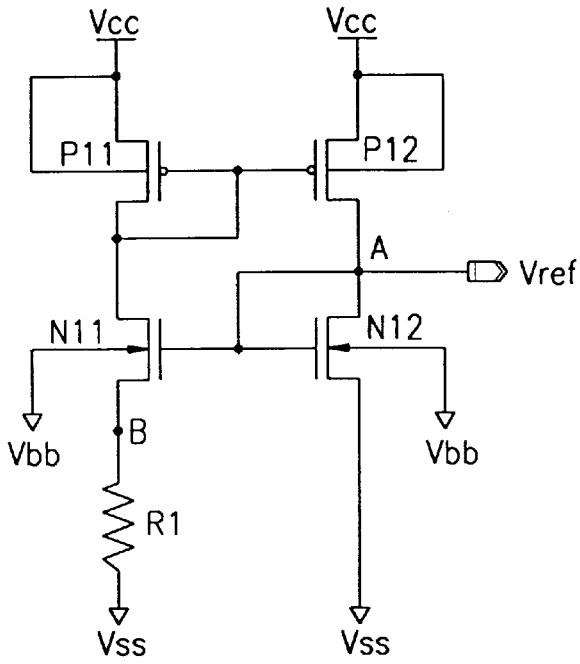
FIG. 1 BACKGROUND ART
FIG. 1 is a schematic block diagram illustrating conventional reference voltage generating circuit.
Figure 2:
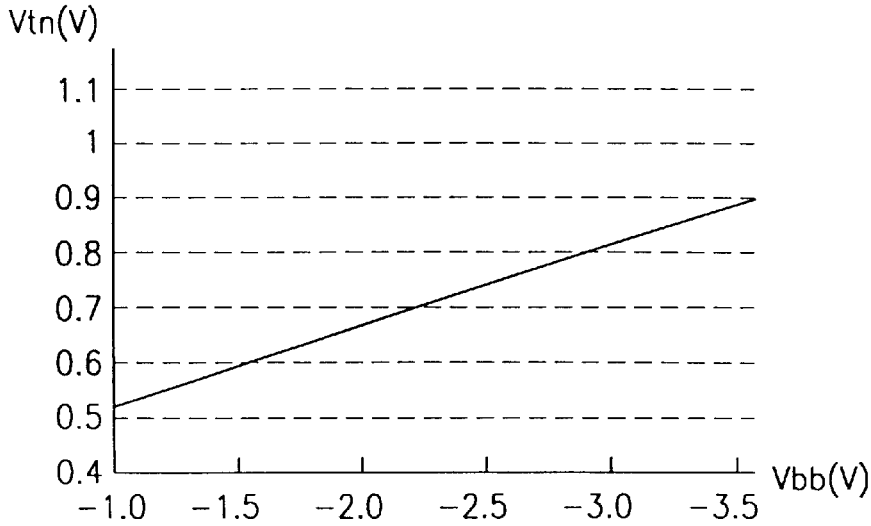
FIG. 2 BACKGROUND ART
FIG. 2 is a graph illustrating a change of a threshold voltage with respect to a change of a back-bias voltage.
Figure 3:
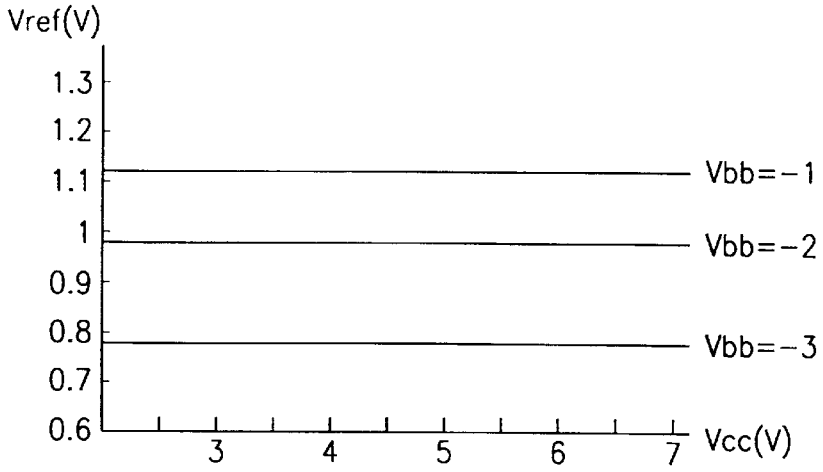
FIG. 3 BACKGROUND ART
FIG. 3 is a graph illustrating a change of a reference voltage with respect to a change of a back-bias voltage.
Figure 4:
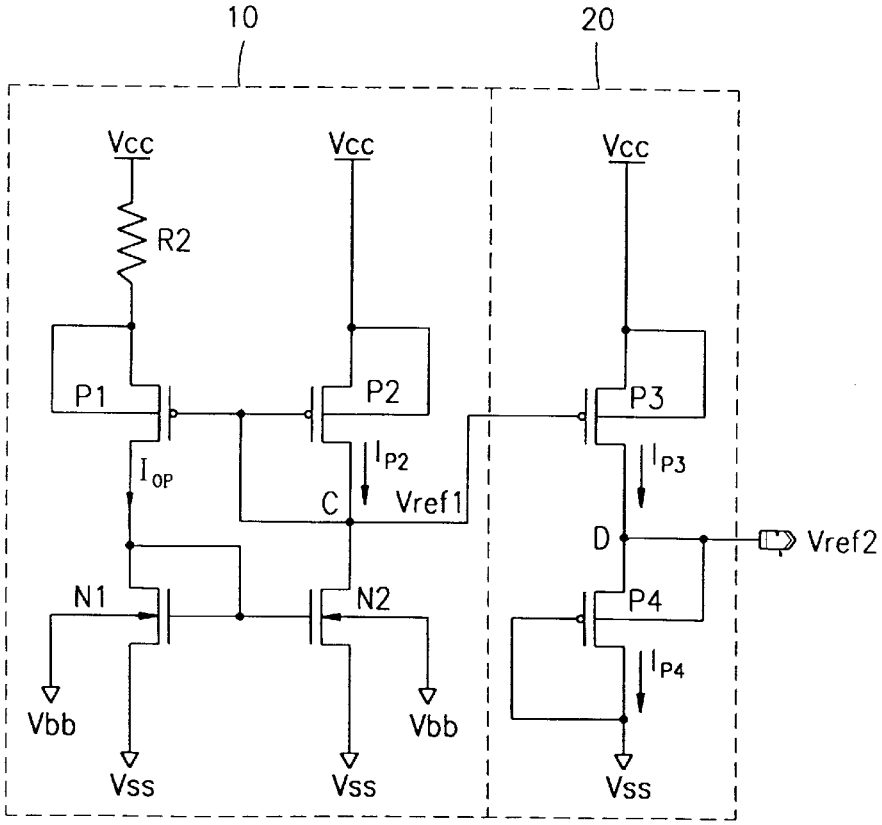
FIG. 4 is a schematic block diagram illustrating a first embodiment of a reference voltage generating circuit according to the present invention.

FIG. 4 illustrates a reference voltage generating circuit according to a first embodiment of the present invention, which generates a reference voltage, using a voltage difference between a gate and a source of a PMOS transistor.

The reference voltage generating circuit is provided with a reference voltage generating unit 10 which generates a reference voltage Vref1 with respect to a power supply voltage Vcc and a level converting unit 20 which converts the reference voltage Vref1 supplied from the reference voltage generating unit 10 to a reference voltage Vref2 with respect to a ground voltage Vss.

The reference voltage generating unit 10 generates the reference voltage Vref1 with respect to a power supply voltage Vcc, using a pair of PMOS transistors P1, P2, and constitutes a current mirror circuit with a resistor R2 and a pair of NMOS transistors N1, N2.

More specifically, the reference voltage generating unit 10 is provided with the PMOS transistor P1 receiving the power supply voltage Vcc over the resistor R2 to a source and a bulk (a bias of an N-Well) thereof, the PMOS transistor P2 having a source and a bulk, both of which receive the power supply voltage Vcc, and a gate connected with a gate of the PMOS transistor P1, and the pair of NMOS transistors N1, N2, each being connected between the drain of the corresponding PMOS transistor P1, P2 and the ground for thus being used as a current mirror circuit. Here, a back-bias voltage Vbb is applied to each bulk of the NMOS transistors N1, N2, the NMOS transistors N1, N2 operate at an active load, and a voltage difference Vgs of each of the PMOS transistors is identical to each other.

On the other hand, the level converting unit 20 is comprised of a pair of PMOS transistors P3, P4 which are serially connected with each other between the power supply voltage Vcc and the ground. A source of the PMOS transistor P3 is connected with a bulk thereof and a gate thereof is commonly connected with the drain and gate of the PMOS transistor P2 of the reference voltage generating unit 10. In addition, the PMOS transistor P4 is a diode-type transistor.

The operation of the first embodiment of reference voltage generating circuit according to the present invention will now be described with reference to the following drawings.

In order to construct the reference voltage generating circuit using the voltage differences Vgs of the PMOS transistors, each bulk of the PMOS transistors P1, P2, that is the bias of the N-Well, is connected with the corresponding source thereof, for thereby eliminating a body effect by not making any voltage difference between the source and bulk of the PMOS transistor.

First, an operation current $I_{op}$ which flows towards an output node C by the current mirror operation of the NMOS transistors N1, N2 can be represented as a following equation (8).

$$I_{op} = \frac{Vgs(P1) - Vgs(P2)}{R2} \tag{8}$$

Additionally, the expression of the reference voltage Vref1 using the equation (6) can be shown as an equation (9) as follows.

$$Vcc - Vref1 = Vtp + \frac{2}{R1 \cdot \beta_{p2}}\left(1 - \frac{1}{K}\right) \tag{9}$$

Here, Vtp and $\beta_{p2}$ denote a threshold voltage of the PMOS transistor and a transconductance of the PMOS transistor P2, respectively.

Accordingly, as the power supply voltage Vcc increases, the reference voltage to the power supply voltage Vcc maintains a uniform voltage value (Vcc−Vref1), and though the threshold voltage Vtn of the NMOS transistor is increased by the equation (8), the voltage value (Vcc−Vref1) still maintains a uniform value, but only a drain voltage of the NMOS transistor N2 is changed.

Since, in a semiconductor chip, all of the voltages are the voltages with regard to a ground voltage Vss, thus the reference voltage Vref1 to the power supply voltage Vcc should be converted to a reference voltage Vref2 with respect to the ground voltage Vss.

When equalizing a voltage difference Vgs(P3) of the PMOS transistor P3 with a voltage difference Vgs(P2) of the PMOS transistor P2, currents $I_{p2}$, $I_{p3}$ which flow towards the PMOS transistors P2, P3, respectively, can be represented as following equations (10), (11).

$$I_{p2} = \frac{\beta_{p2}}{2}[Vgs(P2) - Vtp]^2 \tag{10}$$

$$I_{p3} = \frac{\beta_{p3}}{2}[Vgs(P2) - Vtp]^2 \tag{11}$$

If the width and length of the PMOS transistor P3 are identical with that of the PMOS transistor P2, $\beta_{p2}=\beta_{p3}$ and thus $I_{p2}=I_{p3}$. In addition, the current($I_{p3}$) flows to the diode-type PMOS transistor P4 and thus $I_{p2}=I_{p4}$. Therefore, a following equation (12) can be acceptable.

$$\frac{\beta_{p2}}{2}[Vgs(P2) - Vtp]^2 = \frac{\beta_{p4}}{2}[Vgs(p4) - Vtp]^2 \tag{12}$$

In the equation (12), if the width and length of the PMOS transistor P4 is equalized with that of the PMOS transistor P2, $\beta_{p2}=\beta_{p4}$ and Vgs(P2)=Vgs(P4). Thus, the PMOS transistors P2, P4 eventually have the same voltage difference Vgs. In other words, since the voltage between the power supply voltage Vcc and the reference voltage Vref1 is equalized with a source voltage $V_D$ of the PMOS transistor P4, the source voltage $V_D$ of the PMOS transistor P4 becomes the reference voltage Vref2 with regard to the ground voltage Vss.

Figure 5:
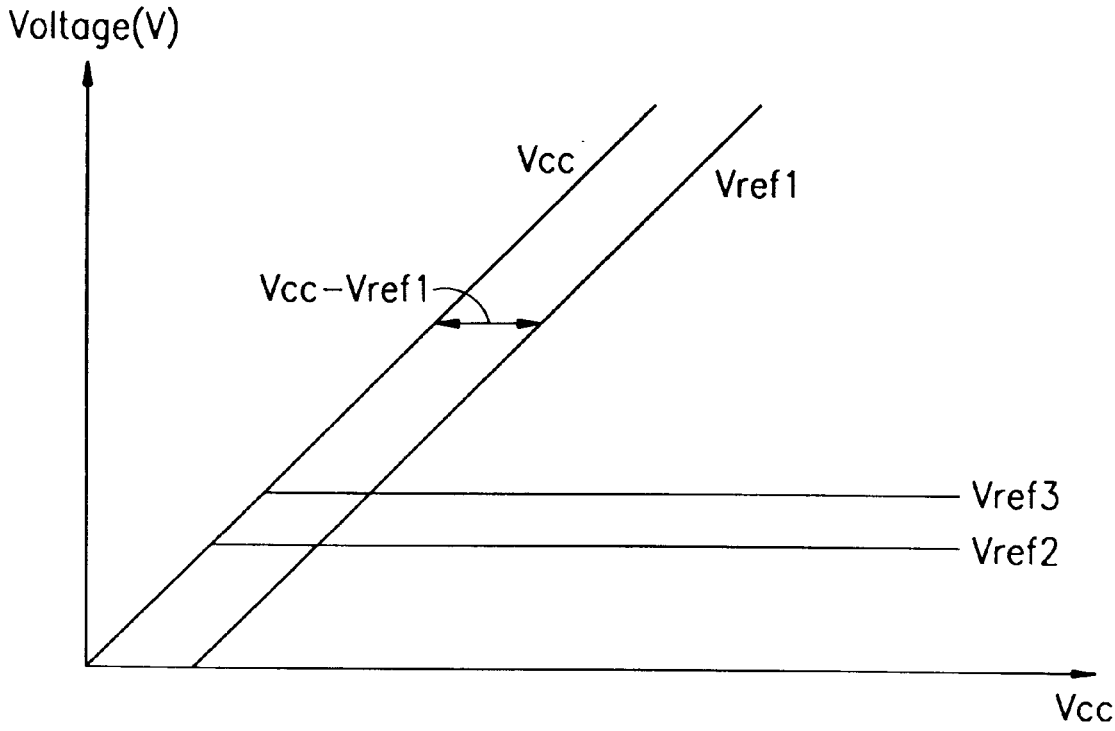
FIG. 5 is a graph wherein a reference voltage to a power supply voltage has been converted to a reference voltage with respect to a ground voltage.

Accordingly, as shown in FIG. 5, the reference voltage Vref1 to the power supply voltage Vcc which is supplied from the reference voltage generating unit 10 varies to the reference voltage Vref2 with respect to the ground voltage Vss in the reference voltage converting unit 20.

Figure 6:
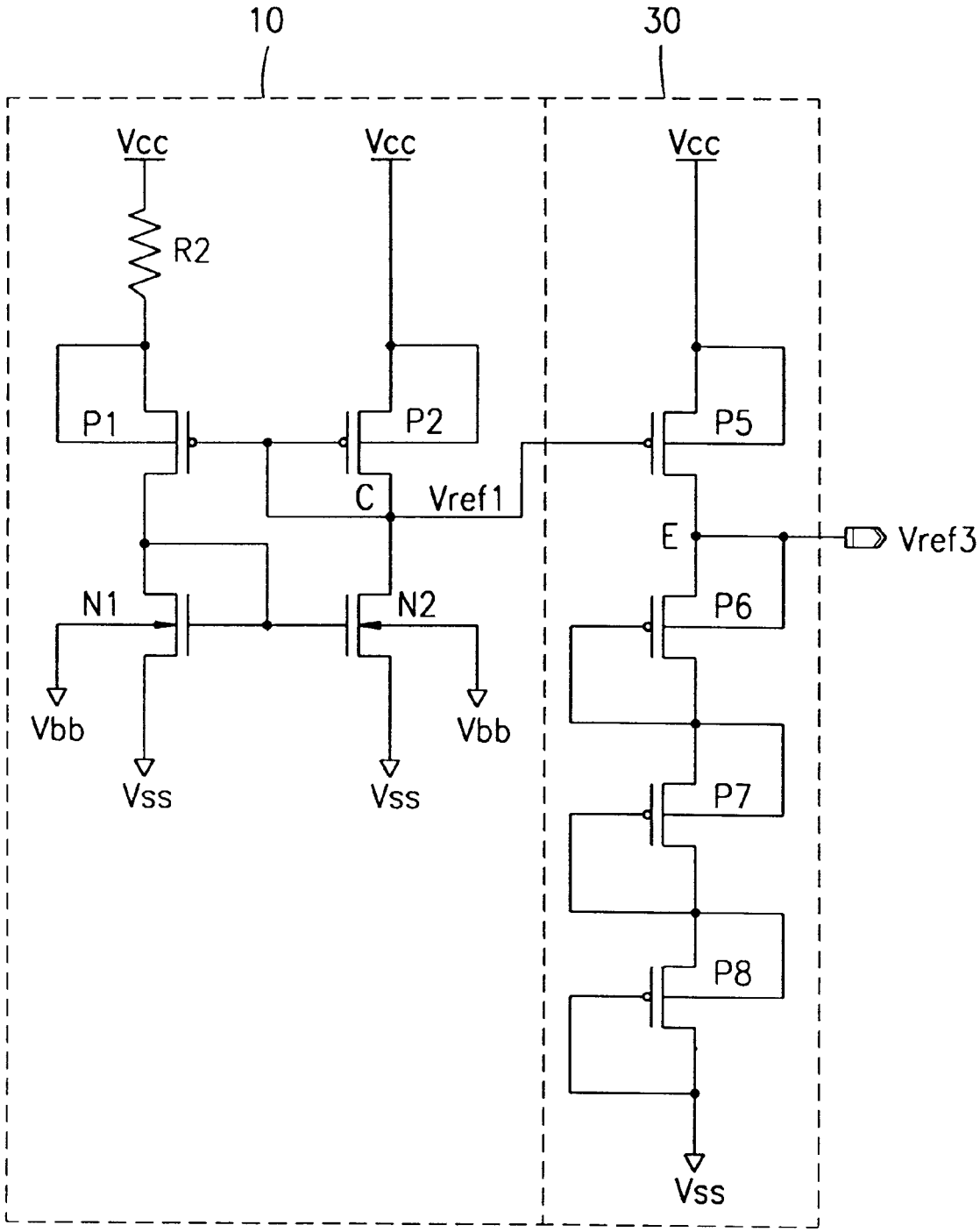
FIG. 6 is a schematic block diagram illustrating a second embodiment of a reference voltage generating circuit according to the present invention.

FIG. 6 illustrates a second embodiment of a reference voltage generating circuit according to the present invention, in which the output node C of the reference voltage generating unit 10 illustrated in FIG. 4 is connected with a level converting unit 30.

The level converting unit 30 is comprised of a PMOS transistor P5 connected between a power supply voltage Vcc and an output node E, and three diode-type PMOS transistors P6–P8 which are connected between the output node E and the ground. At this time, a source of each of the diode-type PMOS transistors P6–P8 is connected with a corresponding bulk and a gate thereof is connected with a drain. Here, the diode-type PMOS transistors P6–P8 have the same W/L(width/length).

In the second embodiment of the present invention, by increasing the number of the diode-type PMOS transistors it becomes possible to obtain a reference voltage Vref3 which is substantially higher than the reference voltage Vref2 generated in the first embodiment.

That is, if the PMOS transistors P1, P2, P5 are identical with the diode-type PMOS transistors P6–P8 W/L wise, the voltage differences Vgs of the above PMOS transistors will be the same. Thus, the reference voltage Vref1 with respect to the power supply voltage Vcc changes to the reference voltage Vref3 with respect to the ground voltage Vss, and the size of the reference voltage Vref3 is about three times as large as that of the reference voltage Vref2. Here, the number of the diode-type PMOS transistors may be adjusted by the user.

As described above, the reference voltage generating circuit of the present invention which generates the reference voltage by using the voltage difference of the PMOS transistor has an effect of generating a uniform reference voltage, irrespective of the change of the back-bias voltage Vbb.

It will be apparent to those skilled in the art that various modifications and variations can be made in the reference voltage generating circuit of the present invention without departing from the spirit or scope of the invention. Thus, it is intended that the present invention cover the modifications and variations of this invention provided they come within the scope of the appended claims and their equivalents.

What is claimed is:

1. A reference voltage generating circuit, comprising:

a reference voltage generating unit for generating a first reference voltage with respect to a power supply voltage; and a level converting unit for converting said first reference voltage outputted from said reference voltage generating unit to a second reference voltage with respect to a ground voltage, and wherein the second reference voltage remains constant regardless of changes in a back-bias voltage, wherein said reference voltage generating unit comprises:

a first PMOS transistor having a source and a bulk which receive the power supply voltage over a resistor;

a second PMOS transistor having a source and a bulk which receive the power supply voltage, and a gate which is connected with a gate of said first PMOS transistor and a first output node; and first and second NMOS transistors each having a bulk for receiving the back-bias voltage, the first NMOS transistor being connected between a drain of the first PMOS transistor and a ground, and the second NMOS transistor being connected between a drain of the second PMOS transistor and the ground, thereby constituting a current mirror.

2. The circuit of claim 1, wherein said reference voltage generating unit generates the first reference voltage by applying a voltage difference between the gate and the source of each of the first and second PMOS transistors.

3. The circuit of claim 1, wherein said level converting unit comprises:

a third PMOS transistor connected between the power supply voltage and a second output node, and having a source which is connected with a bulk thereof and a gate which is connected with the first output node of the reference voltage generating unit and a drain of the second PMOS transistor; and at least one diode-type PMOS transistor which is connected between the second output node and the ground.

4. The circuit of claim 3, wherein said second, third, and said at least one diode-type PMOS transistors have the same W/L (width/length).

5. The circuit of claim 3, wherein currents which respectively flow to the second, third, and said at least one diode-type PMOS transistors have an identical value.

6. The circuit of claim 3, wherein a level of the second reference voltage is determined by the number of said at least one diode-type PMOS transistor.

7. A reference voltage generating circuit, comprising:

a reference voltage generating unit for generating a first reference voltage with respect to a power supply voltage by using a voltage difference between a gate and a source of a PMOS transistor; the reference voltage generating unit comprising:

a first PMOS transistor having a source and a bulk which receive the power supply voltage over a resistor, a second PMOS transistor having a source and a bulk which receive the power supply voltage, and a gate which is connected with a gate of said first PMOS transistor and a first output node, and a first NMOS transistor connected between a drain of the first PMOS transistor and a ground, and a second NMOS transistor connected between a drain of the second PMOS transistor and the ground, thereby constituting a current mirror; and a level converting unit for converting said first reference voltage supplied from said reference voltage generating unit to a second reference voltage with respect to a ground voltage and maintaining the second reference voltage at a constant value regardless of changes in a back-bias voltage applied to a bulk of the first and the second NMOS transistors, the level converting unit comprising:

a third PMOS transistor connected between the power supply voltage and a second output node, and having a source which is connected with a bulk thereof and a gate which is connected with the first output node of the reference voltage generating unit; and at least one diode-type PMOS transistor which is connected between the second output node and the ground.

8. The circuit of claim 7, wherein said first, second, third, and said at least one diode-type PMOS transistors have the same W/L (width/length).

9. The circuit of claim 7, wherein a voltage between the power supply voltage and the first output node is identical with a voltage between the second output node and the ground.

10. The circuit of claim 7, wherein a level of the second reference voltage is determined by the number of said at least one diode-type PMOS transistor.

11. A reference voltage generating circuit, comprising:

a first PMOS transistor having a source and a bulk which receive a power supply voltage over a resistor;

a second PMOS transistor having a source and a bulk which receive the power supply voltage, and a gate which is commonly connected with a gate of the first PMOS transistor and a first output node;

first and second NMOS transistors which are respectively connected with corresponding drains of the first and the second PMOS transistors and a ground, thereby constituting a current mirror, wherein each bulk of the first and second NMOS transistors receives a back-bias voltage;

a third PMOS transistor having a source which is connected with a bulk between the power supply voltage and a second output node, and a gate connected with the first output node; and at least one diode-type PMOS transistor connected between the second output node and the ground.

12. The circuit of claim 11, wherein the first and second NMOS transistors operate at an active region.

13. The circuit of claim 11, wherein said first, second, third, and said at least one diode-type PMOS transistors have the same W/L (width/length).

14. The circuit of claim 11, wherein a first reference voltage between the power supply voltage and the first output node is identical with a voltage between the second output node and the ground, and wherein the voltage between the second output node and the ground constitutes a second reference voltage.

15. The circuit of claim 14, wherein a level of the second reference voltage is determined by the number of said at least one diode-type PMOS transistor.

16. The circuit of claim 11, wherein the first and second PMOS transistors generate a first reference voltage with respect to the power supply voltage by applying a voltage difference between the gate and source thereof.

* * * * *